US009419351B2

(12) United States Patent
Vaccaro et al.

(10) Patent No.: US 9,419,351 B2
(45) Date of Patent: Aug. 16, 2016

(54) CURVED TRANSITION SURFACE INNER CONTACT

(71) Applicant: CommScope Technologies, LLC, Hickory, NC (US)

(72) Inventors: Ronald Alan Vaccaro, Shorewood, IL (US); John Palac, Plainfield, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 14/662,300

(22) Filed: Mar. 19, 2015

(65) Prior Publication Data

US 2015/0194748 A1 Jul. 9, 2015

Related U.S. Application Data

(62) Division of application No. 13/750,157, filed on Jan. 25, 2013, now Pat. No. 9,009,960.

(51) Int. Cl.

| | |
|---|---|
| ***H01R 24/40*** | (2011.01) |
| ***H01R 9/05*** | (2006.01) |
| ***H01R 43/00*** | (2006.01) |
| ***H01R 13/11*** | (2006.01) |
| *H01R 43/16* | (2006.01) |

(52) U.S. Cl.

CPC ..... *H01R 9/0527* (2013.01); *H01R 13/111* (2013.01); *H01R 43/00* (2013.01); *H01R 24/40* (2013.01); *H01R 43/16* (2013.01); *Y10T 29/49204* (2015.01); *Y10T 29/49218* (2015.01)

(58) Field of Classification Search

CPC ..... H01R 2103/00; H01R 13/052; H01R 13/111; H01R 24/40; H01R 13/20; H01R 13/11; H01R 439/851; H01R 439/854; H01R 439/857

USPC ..... 439/851, 854, 857

See application file for complete search history.

(56) References Cited

U.S. PATENT DOCUMENTS

| | | | | |
|---|---|---|---|---|
| 3,963,320 | A | 6/1976 | Spinner | |
| 4,426,127 | A | 1/1984 | Kubota | |
| 4,684,200 | A | 8/1987 | Capp | |
| 4,912,428 | A * | 3/1990 | Shen | H01P 1/045 333/260 |
| 5,167,533 | A | 12/1992 | Rauwolf | |
| 5,518,420 | A * | 5/1996 | Pitschi | H01R 24/564 439/578 |

(Continued)

FOREIGN PATENT DOCUMENTS

FR 2916089 A1 11/2008

OTHER PUBLICATIONS

Sung Gon Kim, International Search Report for application PCT/US2013/069415, Feb. 20, 2014, Daejeon Metropolitan City, Republic of Korea.

(Continued)

*Primary Examiner* — Gary Paumen

(74) *Attorney, Agent, or Firm* — Myers Bigel & Sibley, P.A.

(57) ABSTRACT

An inner contact of a coaxial connector has a body with a plurality of spring fingers, the spring fingers each provided with a contact surface. A plurality of transitions from the contact surfaces are provided as curved surfaces. The curved surfaces may be formed, for example, by chamfer, electrical discharge machining or the like, such that an edge to a slot between the spring fingers does not contact the contact surface.

5 Claims, 6 Drawing Sheets

(56) References Cited

U.S. PATENT DOCUMENTS 5,576,675 A 11/1996 Oldfield
5,795,188 A * 8/1998 Harwath ..... H01R 9/0524 439/583
5,938,474 A 8/1999 Nelson
5,971,770 A 10/1999 Richmond
5,980,290 A 11/1999 Meynier et al.
6,007,388 A 12/1999 Kooiman
6,024,609 A 2/2000 Kooiman et al.
6,053,755 A 4/2000 Oldfield
6,164,977 A 12/2000 Lester
6,238,218 B1 5/2001 Baffert
6,454,601 B1 9/2002 Vaitkus et al.
6,558,177 B2 5/2003 Havener et al.
6,802,739 B2 10/2004 Henningsen
6,840,803 B2 1/2005 Wlos et al.
6,955,562 B1 10/2005 Henningsen
7,121,883 B1 10/2006 Petersen et al.
7,275,957 B1 10/2007 Wlos et al.
7,374,455 B2 5/2008 Purdy et al.
7,442,096 B1 * 10/2008 Gilliam ..... H01R 13/44 439/149
7,448,906 B1 * 11/2008 Islam ..... H01R 9/05 439/578
7,478,475 B2 1/2009 Hall
7,621,778 B1 11/2009 Paynter et al.
7,736,180 B1 6/2010 Paynter
7,803,018 B1 9/2010 Islam
7,819,698 B2 10/2010 Islam
7,898,357 B2 3/2011 Phuyal et al.
7,927,135 B1 4/2011 Wlos
8,033,877 B2 * 10/2011 Di Stefano ..... H05K 3/32 439/851
8,206,176 B2 6/2012 Islam
2002/0049005 A1 * 4/2002 Leve ..... H01R 13/17 439/825
2002/0076964 A1 * 6/2002 Weisz-Margulescu ..... H01R 13/424 439/263
2005/0277317 A1 12/2005 Peng
2007/0049113 A1 3/2007 Rodrigues et al.
2009/0053931 A1 * 2/2009 Islam ..... H01R 9/05 439/578
2009/0269993 A1 * 10/2009 Zhang ..... H01R 13/17 439/825
2010/0190377 A1 * 7/2010 Islam ..... H01R 9/0527 439/584
2010/0233903 A1 9/2010 Islam
2012/0214357 A1 * 8/2012 Flaherty, IV ..... H01R 13/111 439/851

OTHER PUBLICATIONS

Extended European Search Report Corresponding to European Application No. 13872743.3; Dated: Nov. 13, 2015, 2013;10 Pages.

* cited by examiner

CURVED TRANSITION SURFACE INNER CONTACT

BACKGROUND

1. Field of the Invention

This invention relates to electrical cable connectors. More particularly, the invention relates to an inner contact for a coaxial connector with improved passive intermodulation distortion (PIM) electrical performance and mechanical interconnection characteristics.

2. Description of Related Art

Coaxial cable connectors are used, for example, in communication systems requiring a high level of precision and reliability.

To create a secure electro-mechanical interconnection between the cable and the connector, it is desirable to have generally uniform, circumferential contact between the conductors of the coaxial cable and the coaxial connector. Interconnection with the inner conductor may be provided by an inner contact utilizing a plurality of spring fingers to securely engage the inner conductor. Representative of this technology is commonly owned U.S. Pat. No. 7,803,018, titled "Inner Conductor End Contacting Coaxial Connector and Inner Conductor Adapter Kit" issued 28 Sep. 2010 to Nahid Islam.

During systems installation, axial and/or rotational forces may be applied to the connector, for example as the inner conductor is inserted into engagement with the inner contact and the attached coaxial cable is routed towards the next interconnection and maneuvered into position and/or curved for alignment with cable supports and/or retaining hangers. Rotation of the coaxial cable and coaxial connector with respect to each other may damage the connector, the cable and/or the integrity of the cable/connector inter-connection. Further, once installed, twisting, bending and/or vibration applied to the interconnection over time may degrade the connector to cable interconnection and/or introduce PIM.

Competition in the coaxial cable connector market has focused attention on improving electrical performance and minimization of overall costs, including materials costs, and training requirements for installation personnel.

Therefore, it is an object of the invention to provide an inner contact for a coaxial connector that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventors have recognized that initial insertion, movement and/or skewing of alignment between the inner contact of a coaxial connector and the inner conductor of a coaxial cable may scrape and/or scratch the surface of the inner conductor, generating PIM.

The scraping and/or scratching is believed to result in part from the sharp edges at the sides of the spring finger contact areas generated by conventional methods of forming the spring fingers of the inner contact, such as machining by sawing or the like across the end of the inner contact to form the spring fingers, leaving sharp edges therebetween. The scraping and/or burrs remaining along the sharp edges may also generate metal chips that can then migrate within the interconnection area, creating a further source of PIM.

Figure 1:
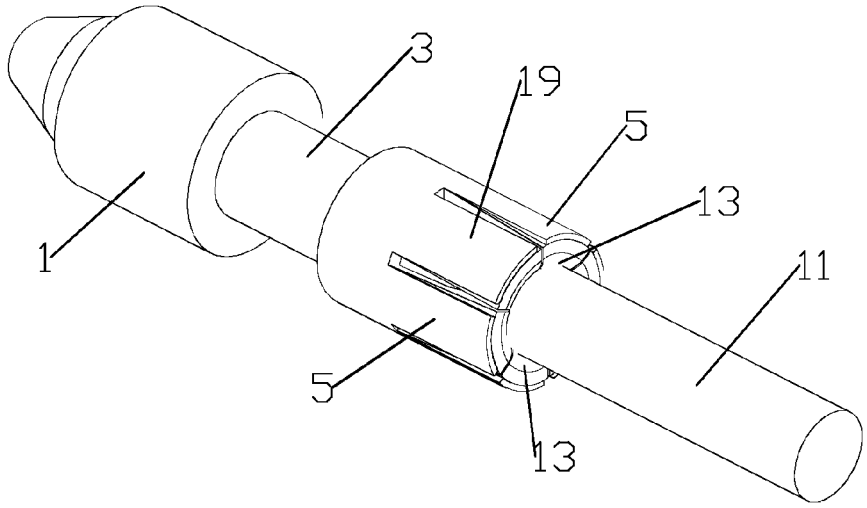
FIG. 1 is a schematic isometric view of an exemplary inner contact engaged with an inner conductor.
Figure 2:
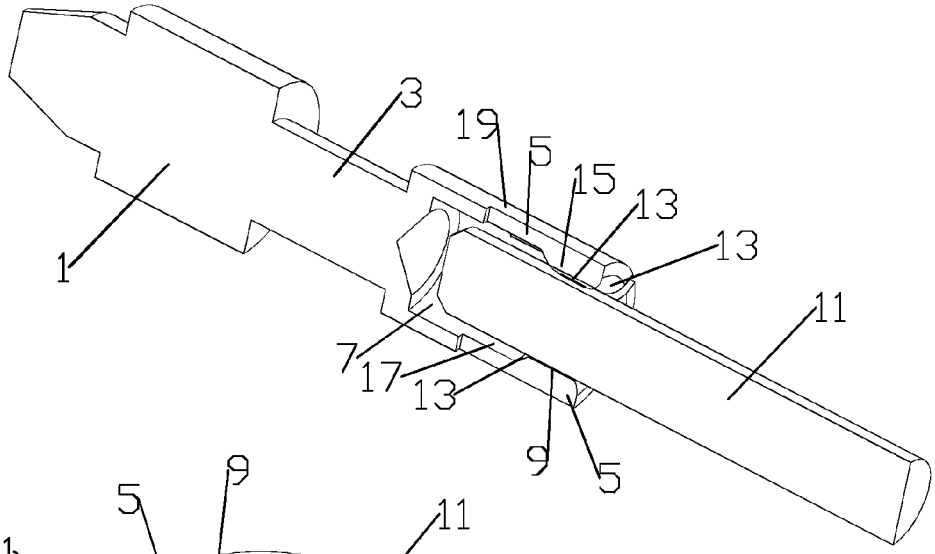
FIG. 2 is a schematic isometric cut-away view of the assembly of FIG. 1.
Figure 3:
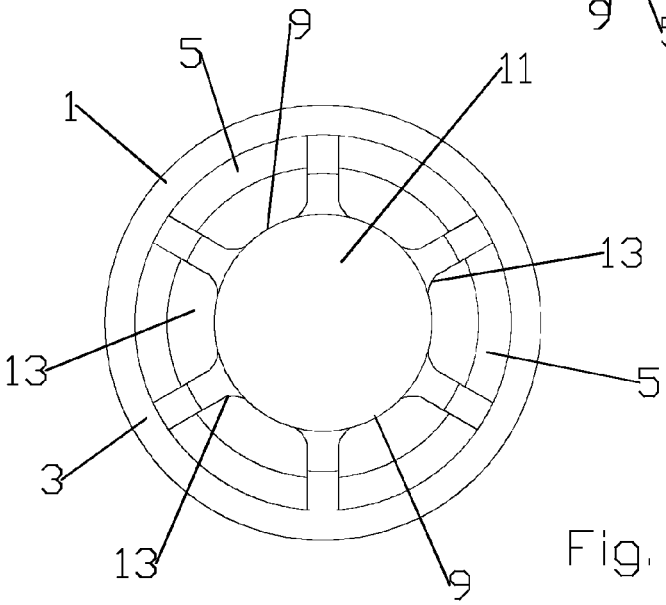
FIG. 3 is a schematic end view of the assembly of FIG. 1.

As shown for example in FIGS. 1-3, an exemplary inner contact 1 of a coaxial connector has a body 3 with a plurality of spring fingers 5 formed from a portion of the body 3 surrounding an inner conductor bore 7 open to a cable end of the inner contact 1. The spring fingers 5 are each provided with a contact surface 9 positioned, for example, proximate a distal end of the spring fingers 5, the contact surfaces 9 dimensioned to contact the inner conductor 11 of a coaxial cable interconnected with the coaxial connector.

Transitions 13 from the periphery of the contact surfaces 9 to the remainder of the spring finger 5 may be provided as curved surfaces. The curved surfaces may be formed including a radius, chamfer, relief and the like. Thereby the periphery of the contact surfaces 5 may be provided without sharp edges or burrs.

Figure 4:
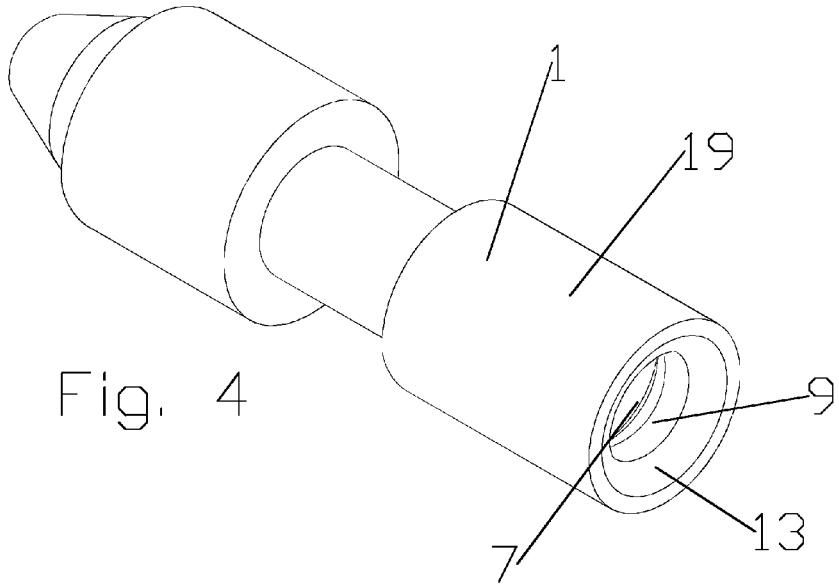
FIG. 4 is a schematic isometric view of a body, prior to initiating processing into an inner contact.
Figure 5:
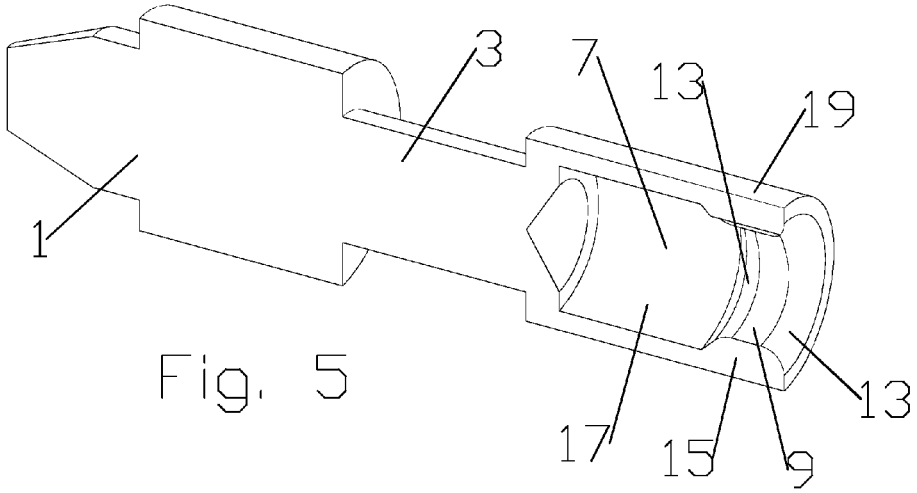
FIG. 5 is a schematic isometric cut-away view of the body of FIG. 4.

The inner contact 1 with spring fingers 5 and curved surface transitions 13 may be cost efficiently manufactured, for example, by forming the curved surface transitions 13 upon a body 3 provided with an inner conductor bore 7 at the cable end, for example as shown in FIGS. 4 and 5. An inward projecting annular projection 15 may be provided proximate a distal end of the inner conductor bore 7 for further processing into the desired contact surfaces 9 and curved surface transitions 13. The curved surfaces may be applied, for example by broaching or electrical discharge machining, to obtain a curved surface without introducing sharp edges at the periphery of the contact surfaces 9 where the machining removes material.

Figure 6:
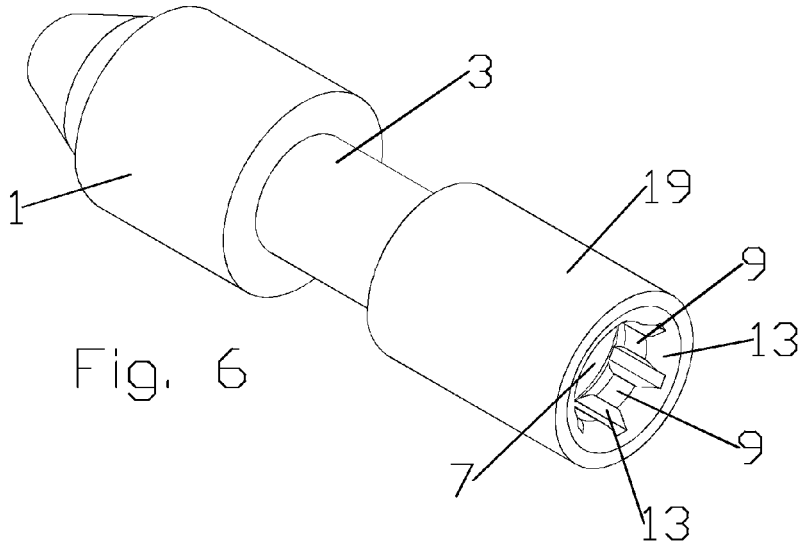
FIG. 6 is a schematic isometric view of the body of FIG. 4, after chamfering.
Figure 7:
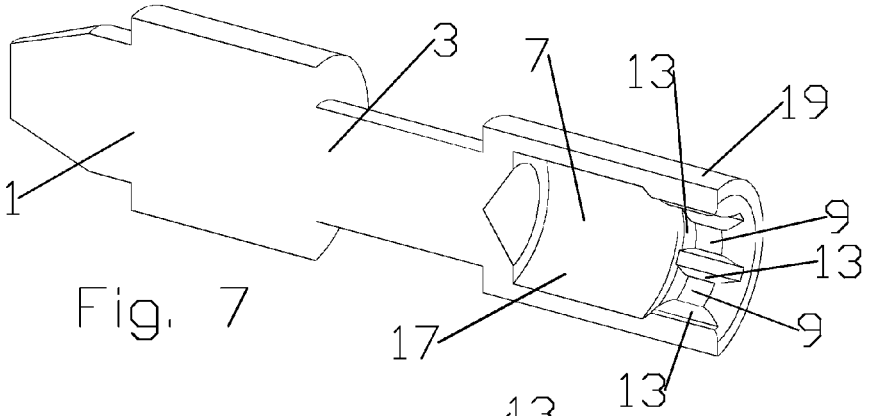
FIG. 7 is a schematic isometric cut-away view of the body of FIG. 6.
Figure 8:
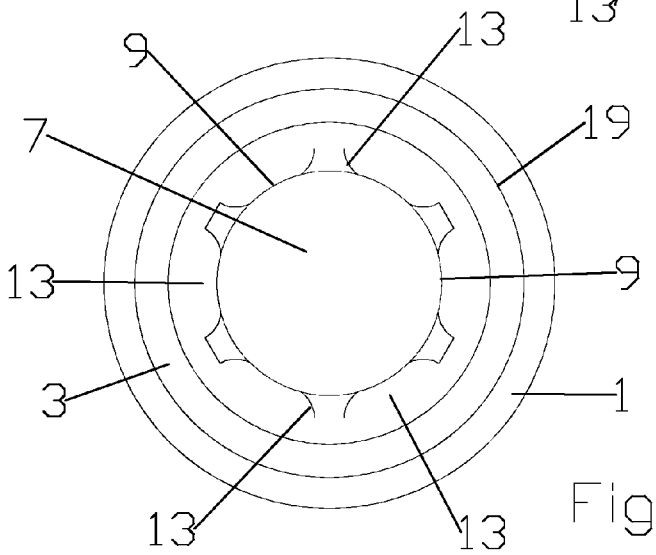
FIG. 8 is a schematic end view of the body of FIG. 6.
Figure 9:
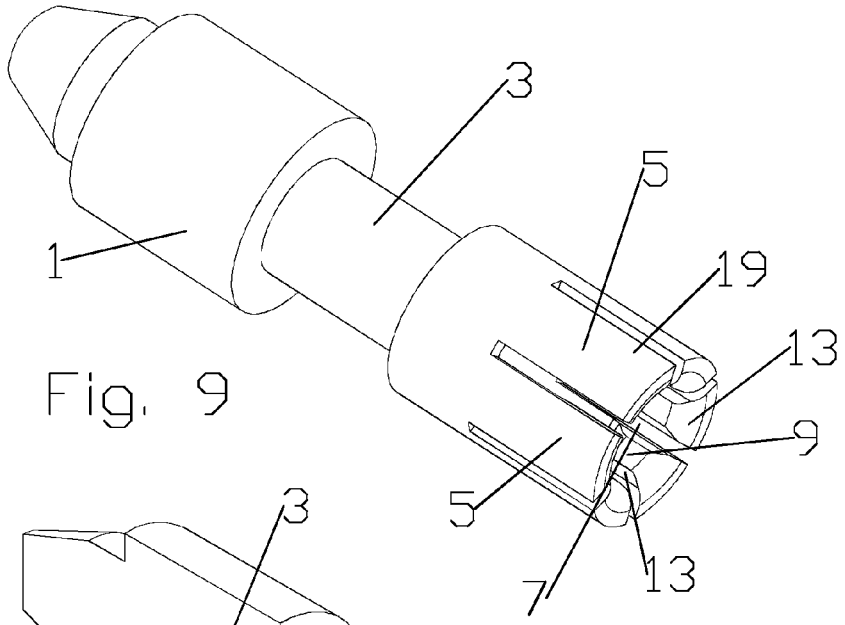
FIG. 9 is a schematic isometric view of the body of FIG. 6, after slotting.
Figure 10:
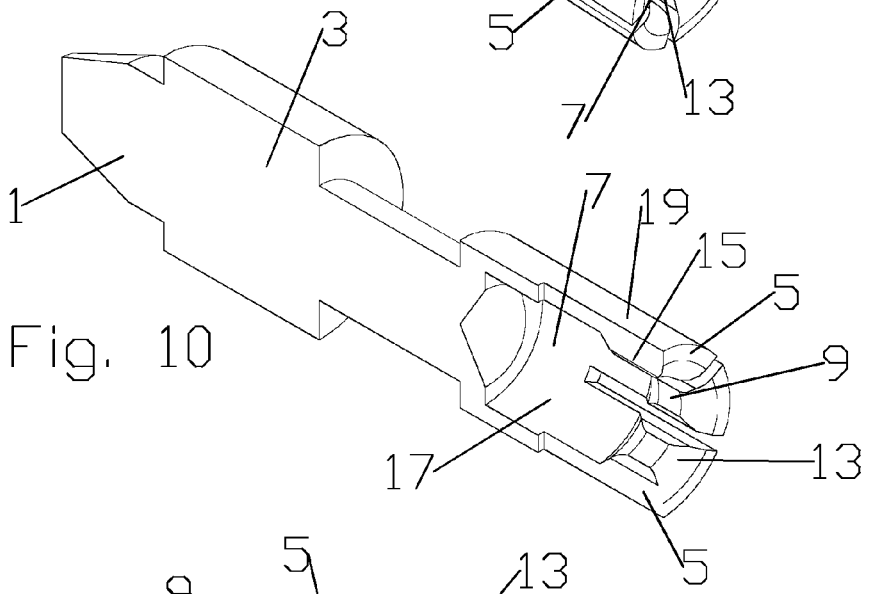
FIG. 10 is a schematic isometric cut-away view of the body of FIG. 9.
Figure 11:
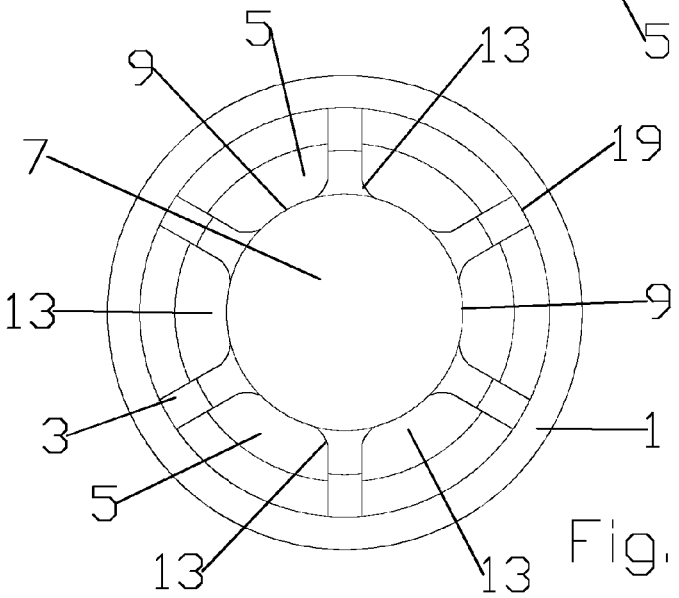
FIG. 11 is a schematic end view of the body of FIG. 9

After the curved surface transitions have been machined, for example as shown in FIGS. 6-8, slots defining the spring fingers 5 may be applied, for example by conventional machining such as sawing or the like, between the transitions 13, for example as shown in FIGS. 9-11. Alternatively, the order of operation may be reversed by machining the slots and then applying the curved surface of the transitions 13 to the edges between the slots and the contact surfaces 9.

Because an edge between the transitions 13 and the slots is spaced away from the contact surfaces 9, any sharp edge or burr generated at the intersection of the slot and the transition 13 by the use of conventional sawing or the like will not contact the inner conductor 11.

Figure 12:
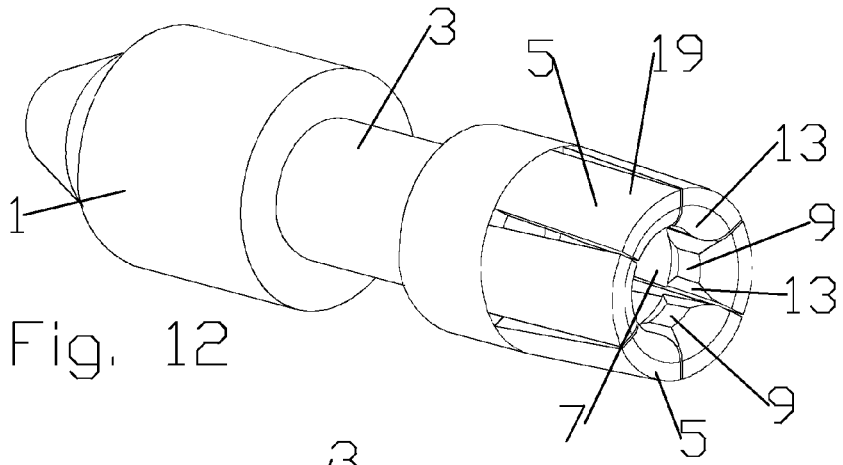
FIG. 12 is a schematic isometric view of the body of FIG. 9, after swaging.
Figure 13:
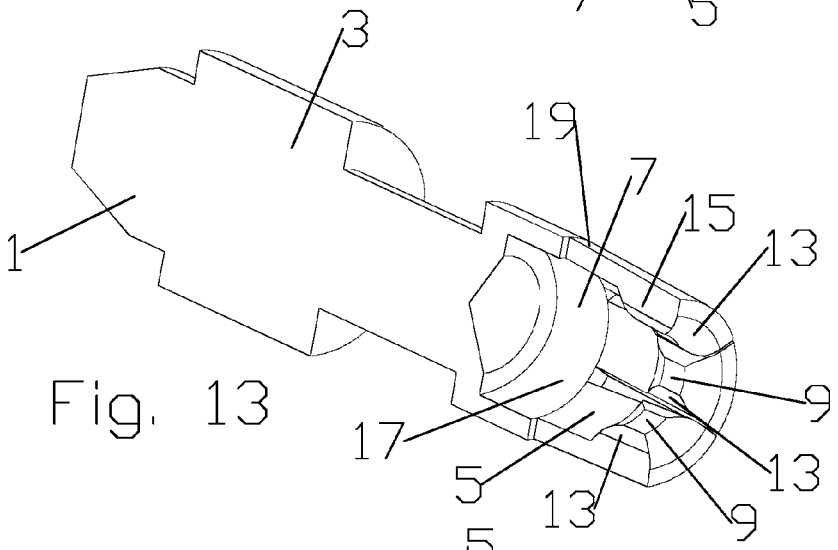
FIG. 13 is a schematic isometric cut-away view of the body of FIG. 12.
Figure 14:
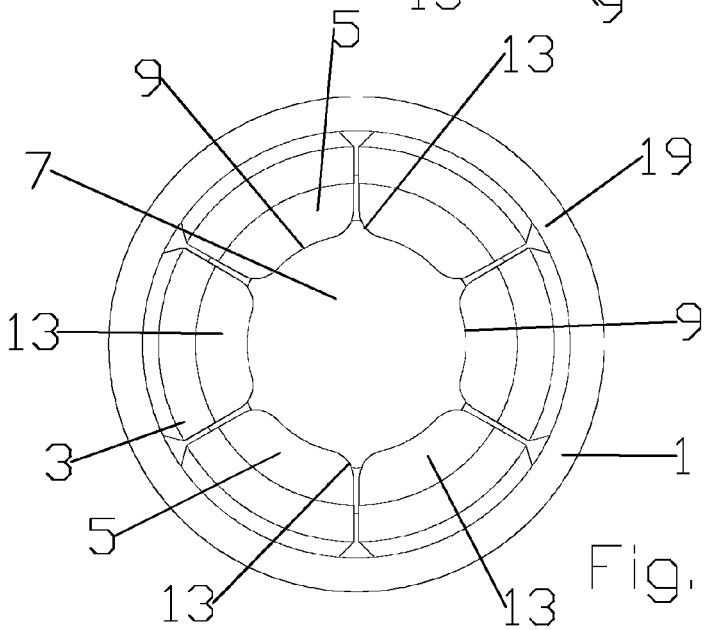
FIG. 14 is a schematic end view of the body of FIG. 12.

A swaging operation may be applied, for example radially inward proximate the distal end of the spring fingers 5, to increase a bias of the spring fingers 5 upon the inner conductor 11, for example as shown in FIGS. 12-14.

Figure 15:
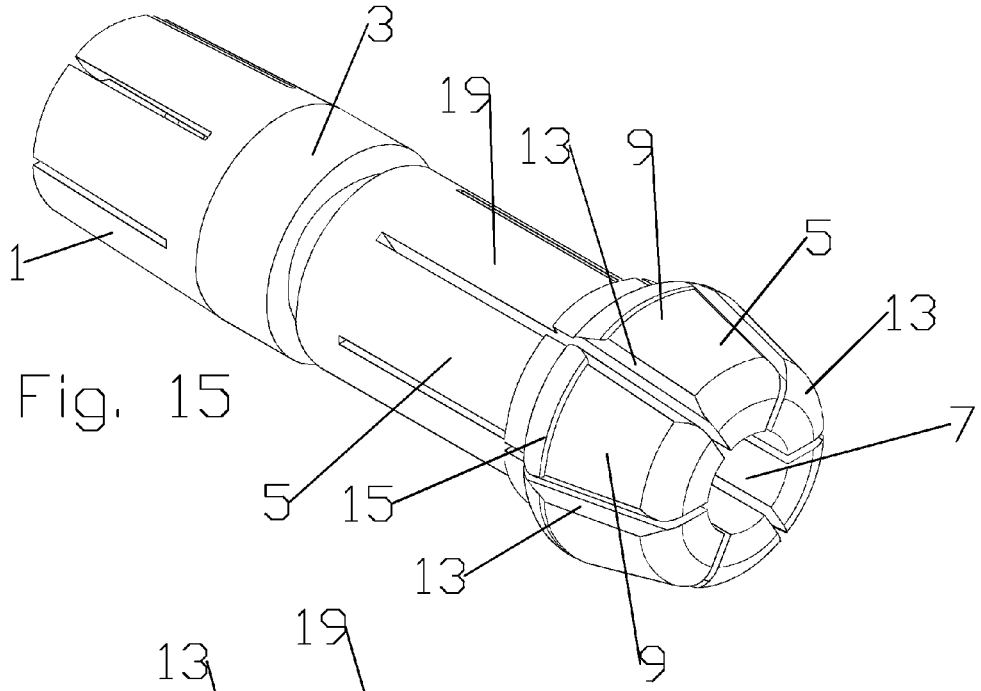
FIG. 15 is a schematic isometric view of an alternative embodiment of an inner contact for hollow inner conductors.
Figure 16:
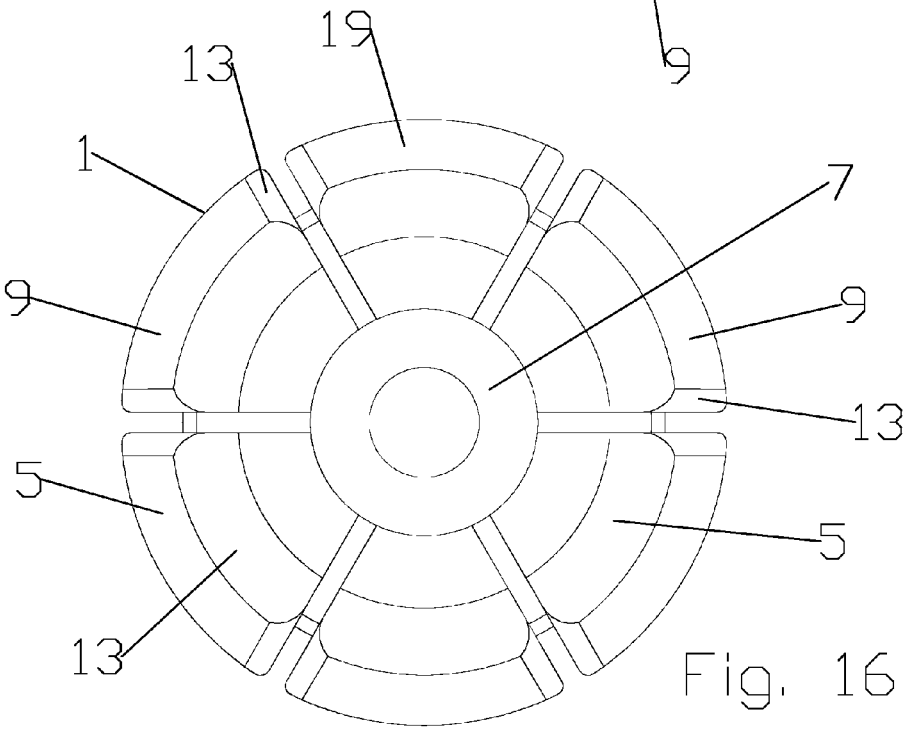
FIG. 16 is a schematic end view of the inner contact of FIG. 15.

One skilled in the art will appreciate that inner contacts 1 with curved surface transitions 13 may be configured to engage the outer diameter of an inner conductor 11 by applying the contact surfaces 9 to an inner surface 17 of the spring fingers 5, or alternatively the inner diameter of a hollow inner conductor by applying the contact surfaces 9 to an outer surface 19 of the spring fingers 5. In outer diameter contact surface configurations, for example as shown in FIGS. 15 and 16, the outward projecting annular projection 15 may be provided on an outer diameter of the distal end of the inner contact 1.

One skilled in the art will appreciate that contact surfaces of inner contacts with periphery transitions applied as curved surfaces may decrease PIM generation and thereby improve interconnection electrical performance. Further, because scratching of the inner conductor is less likely even if the installation steps are performed roughly, installation may be successfully performed by personnel with lower training requirements.

Table of Parts

| | |
|---|---|
| 1 | inner contact |
| 3 | body |
| 5 | spring finger |
| 7 | inner conductor bore |
| 9 | contact surface |
| 11 | inner conductor |
| 13 | transition |
| 15 | annular projection |

-continued

Table of Parts

| | |
|---|---|
| 17 | inner surface |
| 19 | outer surface |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. An inner contact of a coaxial connector, comprising:

a body with a plurality of spring fingers, the spring fingers each provided with a contact surface;

a plurality of transitions between a periphery of each of the contact surfaces and their respective spring fingers, including transitions proximate adjacent spring fingers, provided as curved surfaces;

wherein the contact surface is on an outer surface of the spring fingers.

2. The inner contact of claim 1, wherein the curved surface is a radius.

3. The inner contact of claim 1, wherein the curved surface is a chamfer.

4. The inner contact of claim 1, wherein the curved surface is a relief.

5. The inner contact of claim 1, wherein the contact surfaces are provided proximate a distal end of the spring fingers.

* * * * *